US007523566B2

(12) United States Patent
Young-Chul

(10) Patent No.: US 7,523,566 B2
(45) Date of Patent: Apr. 28, 2009

(54) SHOE SOLE

(75) Inventor: Kwon Young-Chul, Busan (KR)

(73) Assignee: Treksta, Inc, Busan (KR)

( * ) Notice: Subject to any disclaimer, the term of this patent is extended or adjusted under 35 U.S.C. 154(b) by 433 days.

(21) Appl. No.: 11/445,576

(22) Filed: Jun. 2, 2006

(65) Prior Publication Data

US 2007/0277401 A1 Dec. 6, 2007

(30) Foreign Application Priority Data

Jun. 3, 2005 (KR) ..... 10-2005-0047513

(51) Int. Cl.
*A43B 13/18* (2006.01)

(52) U.S. Cl. ..... 36/30 R; 36/59 R; 36/28

(58) Field of Classification Search ..... 36/59 R, 36/30 R, 31, 28, 25 R
See application file for complete search history.

(56) References Cited

U.S. PATENT DOCUMENTS 5,655,314 A 8/1997 Petracci

*Primary Examiner*—Ted Kavanaugh
(74) *Attorney, Agent, or Firm*—DeLio & Peterson, LLC; Peter W. Peterson

(57) ABSTRACT

Disclosed is a shoe sole capable of horizontally maintaining an inner bottom section of footwear when the user walks. The shoe sole includes an outsole provided at front and rear portions thereof with a plurality of protrusions, a mid-sole stacked on the upper surface of the outsole and formed with a plurality of perforation holes, an insert provided at a bottom surface thereof with a plurality of protrusions, which are inserted into the outer wheels by passing through the perforation holes of the mid-sole, and a lasting board stacked on an upper surface of the insert coupled with the mid-sole. The inner bottom section of footwear is horizontally maintained. The shoe sole attenuates foot fatigue and provides comfortable wearing feeling when the user walks on an unpaved road or climbs a mountain.

5 Claims, 8 Drawing Sheets

PRIOR ART

PRIOR ART

SHOE SOLE

BACKGROUND OF THE INVENTION

1. Field of the Invention

The present invention relates to a shoe sole, capable of horizontally maintaining an inner bottom section of footwear when a user walks. More particularly, the present invention relates to a shoe sole, in which a plurality of protrusions are provided on a bottom surface of an outsole such that the protrusions can move independently from each other, a mid-sole and an insert are sequentially stacked on the outsole, and a plurality of elastic protrusions protrude downward from a bottom surface of the insert by passing through the mid-sole in order to support the protrusions of the outsole, so that the protrusions of the outsole can move independently from each other while being supported by the elastic protrusions even if load is applied to the shoe sole, thereby horizontally maintaining an inner bottom section of the footwear.

2. Description of the Prior Art

Recently, as the standard of living rises, various leisure activities have been increasingly proposed. In this regard, there are great demands for functional footwear suitable for the leisure activities. For this reason, various types of functional footwear suitable for the leisure activities have been developed and appeared on the market. Although structures of the footwear may vary depending on the functional purposes thereof, the footwear basically includes a shoe sole and an upper coupled to an upper portion of the shoe sole.

In addition, the shoe sole includes a mid-sole for providing cushion to the footwear, and an outsole provided at the outermost portion of the shoe sole such that the outsole can make contact with the ground. In the above shoe sole of the footwear, the mid-sole is fabricated using various synthetic resins by foaming the synthetic resins such that an elastic property can be imparted to the mid-sole. In addition, the outsole is made from rubber materials such that the outsole has abrasion-resistant and sliding-resistant characteristics.

In particular, recently, EVA (ethylene-vinyl acetate copolymer) resin having light weight and superior shock-absorbing and restoring properties has been extensively used as a material for the mid-sole. Since the mid-sole must have a property different from that of the outsole, the mid-sole is fabricated separately from the outsole and then is bonded to the outsole by applying an adhesive between the outsole and the mid sole, thereby obtaining the shoe sole of the footwear.

A basic purpose of the shoe sole of the footwear is to protect the sole of a foot while attenuating impact applied to the human body through the foot. In this regard, various shock-absorbing structures have been developed in order to reduce impact applied to the human body through the shoe sole of the footwear. For instance, a shock-absorbing gel has been suggested. However, since only a small amount of shock-absorbing gel is applied to a heel part of the footwear, the shock-absorbing gel cannot sufficiently absorb impact applied to the human body.

In order to solve the above problem, various shock-absorbing structures suitable for the shoe sole have been filed and registered in Korean Intellectual Property Office. For instance, Korean Unexamined Patent Publication No. 2004-54868 discloses a "shoe sole having shock-absorbing function".

FIG. 1 is an exploded sectional view illustrating the shoe sole disclosed in Korean Unexamined Patent Publication No. 2004-54868. As shown in FIG. 1, the shoe sole includes a mid-sole 10 formed at front and rear portions thereof with installation recesses 11 and 12, respectively. In addition, a plurality of insertion recesses 13 and 14 are formed on bottoms of the installation recesses 11 and 12. A plurality of shock-absorbing sponge members 15 and 16 are fixedly inserted into the insertion recesses 13 and 14 formed in the installation recesses 11 and 12, respectively. In addition, a transparent window 21*a* is installed at front and rear portions of an outsole 20, on which the mid-sole 10 is stacked, such that a user can view the shock-absorbing sponge members 15 and 16 provided at front and rear portions of the mid-sole 10.

The shoe sole having the above structure can absorb an external pressure applied thereto through the outsole 20, because the shock-absorbing sponge members 15 and 16 are coupled with the mid-sole 10, respectively. However, since only the upper end potions of the shock-absorbing sponge members 15 and 16 are fixedly inserted into the insertion recesses 13 and 14, the shock-absorbing sponge members 15 and 16 may be easily released from the insertion recesses 13 and 14, if the external pressure is continuously applied to the shoe sole. In addition, since the outsole, on which the mid-sole is stacked, is fabricated as one piece, the external pressure applied to the front or rear portion of the shoe sole may be distributed over the whole area of the shoe sole.

In addition, Korean Unexamined Patent Publication No. 1998-76776 discloses a "shoe sole including a cushion tube having a dual cavity". FIG. 2 is a schematic view illustrating the structure of the shoe sole disclosed in Korean Unexamined Patent Publication No. 1998-76776. As shown in FIG. 2, the shoe sole includes an inner tube 20 interposed between upper and lower covers 20 and 30, in which a plurality of cylindrical cavity sections 11 are formed in the inner tube 20 while being connected to each other on the same plane by means of a plurality of passages 12.

The shoe sole having the above structure can provide sufficient cushion because the inner tube is filled with air and air layers are formed between the inner tube and the upper cover and between the inner tube and the lower cover. However, the shoe sole may provide excessive cushion. In this case, stability of the user wearing the footwear may be degraded. In addition, the structure of the shoe sole is so complicated that the production of such a shoe sole is not economical.

SUMMARY OF THE INVENTION

Accordingly, the present invention has been made to solve the above-mentioned problems occurring in the prior art, and an object of the present invention is to provide a shoe sole, in which a plurality of protrusions are provided on a bottom surface of an outsole making contact with the ground such that the protrusions can move independently, and a means for absorbing impact transferred through each protrusion is installed in footwear, so that the shoe sole can effectively absorb external impact and an inner bottom section of the footwear can be horizontally maintained even if a user walks on an unpaved road, thereby attenuating foot fatigue.

In order to accomplish this object, according to the present invention, there is provided a shoe sole comprising an outsole provided at front and rear portions of a bottom surface thereof with a plurality of protrusions, which can move independently, and an insert having protrusions, which are made from elastic materials in order to elastically support the protrusions of the outsole.

The shoe sole according to the present invention includes an outsole, which makes contact with the ground, a mid-sole having a plate shape and being stacked on an upper surface of the outsole in footwear, an insert inserted into a recess formed on an upper surface of the mid-sole, and a lasting board stacked on the upper surface of the mid-sole coupled with the insert.

The outsole is provided at front and rear portions of a bottom surface thereof with a plurality of protrusions making contact with the ground. The protrusions can move independently. That is, a connection ring having an inverted-U shaped section and a relatively thin thickness is formed between an upper end portion of the protrusion and the bottom surface of the outsole has, so that each protrusion can be moved relative to the bottom surface of the outsole about the connection ring having the inverted-U shaped section.

For instance, when viewed in a section, a sidewall of the protrusion vertically and downwardly extends from one lower end portion of the inverted-U shaped connection ring and the bottom surface of the outsole horizontally extends from the other lower end portion of the inverted-U shaped connection ring. In addition, the inverted-U shaped connection ring protrudes upward from an upper surface of the outsole.

At this time, when viewed in a plan view, the inverted-U shaped connection ring forms a closed loop while surrounding the protrusion. Thus, the inverted-U shaped connection ring is called an "outer wheel".

The mid-sole is stacked on the upper surface of the outsole so as to provide the strength and cushion to the shoe sole. The mid-sole is a plate-shaped mat and is formed with a plurality of perforation holes aligned corresponding to the protrusions formed at front and rear portions of the outsole.

The insert is a plate member stacked on the upper surface of the mid-sole. The insert is provided at a bottom surface thereof with a plurality of protrusions aligned corresponding to the protrusions of the outsole. When the insert is stacked on the upper surface of the mid-sole, the protrusions of the insert, which protrude downward from the bottom surface of the insert, are inserted into the outer wheels by passing through the perforation holes of the mid-sole, thereby elastically supporting the protrusions of the outsole.

At this time, it is not necessary to design the insert with a size identical to a size of the mid-sole. That is, it is sufficient if the insert can cover the front and rear portions of the outsole provided with the protrusions. Thus, it is also possible to provide a pair of inserts such that the inserts can cover the front and rear portions of the outsole, respectively.

If the size of the insert is smaller than that of the mid-sole, or if a pair of inserts are provided, a stepped portion is formed when the insert is stacked on the upper surface of the mid-sole because the upper surface of the insert may protrude from the upper surface of the mid-sole. In this case, it is preferred to planarize the upper surface of the insert in line with the upper surface of the mid-sole by forming a recess on the upper surface of the mid-sole and accommodating the insert in the recess.

The lasting board is fixedly stacked on the upper surface of the insert provided on the upper surface of the mid-sole, thereby forming the inner bottom section of footwear. The lasting board stably supports the insert in such a manner that the protrusions of the insert can stably support the protrusions of the outsole while applying the elastic force to the protrusions of the outsole even if the protrusions of the outsole are moved due to external impact applied thereto.

According to the shoe sole of the present invention having the above structure when the outsole makes contact with the ground, the protrusions of the outsole are pressed with different pressures according to the ground state, so the protrusions of the outsole can move independently from each other. At this time, since the protrusions of the outsole are elastically supported by the protrusions of the insert, which are inserted into the outer wheels, the contour of an outer bottom section of the footwear formed by the protrusions of outsole may match with the contour of the ground, and the contour of the inner bottom section of the footwear, that is, the upper surface of the lasting board can be horizontally maintained.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
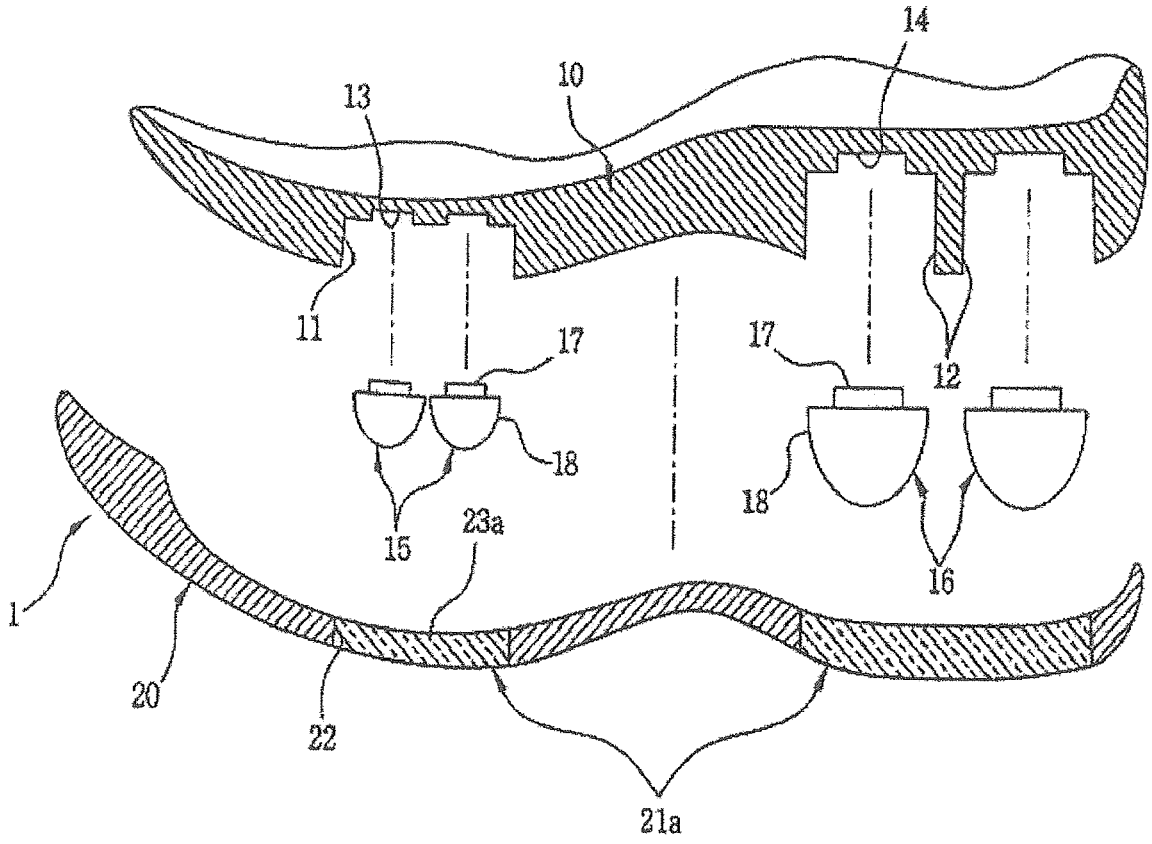
FIG. 1 is a sectional view illustrating a conventional shock-absorbing structure for a shoe sole.
Figure 2:
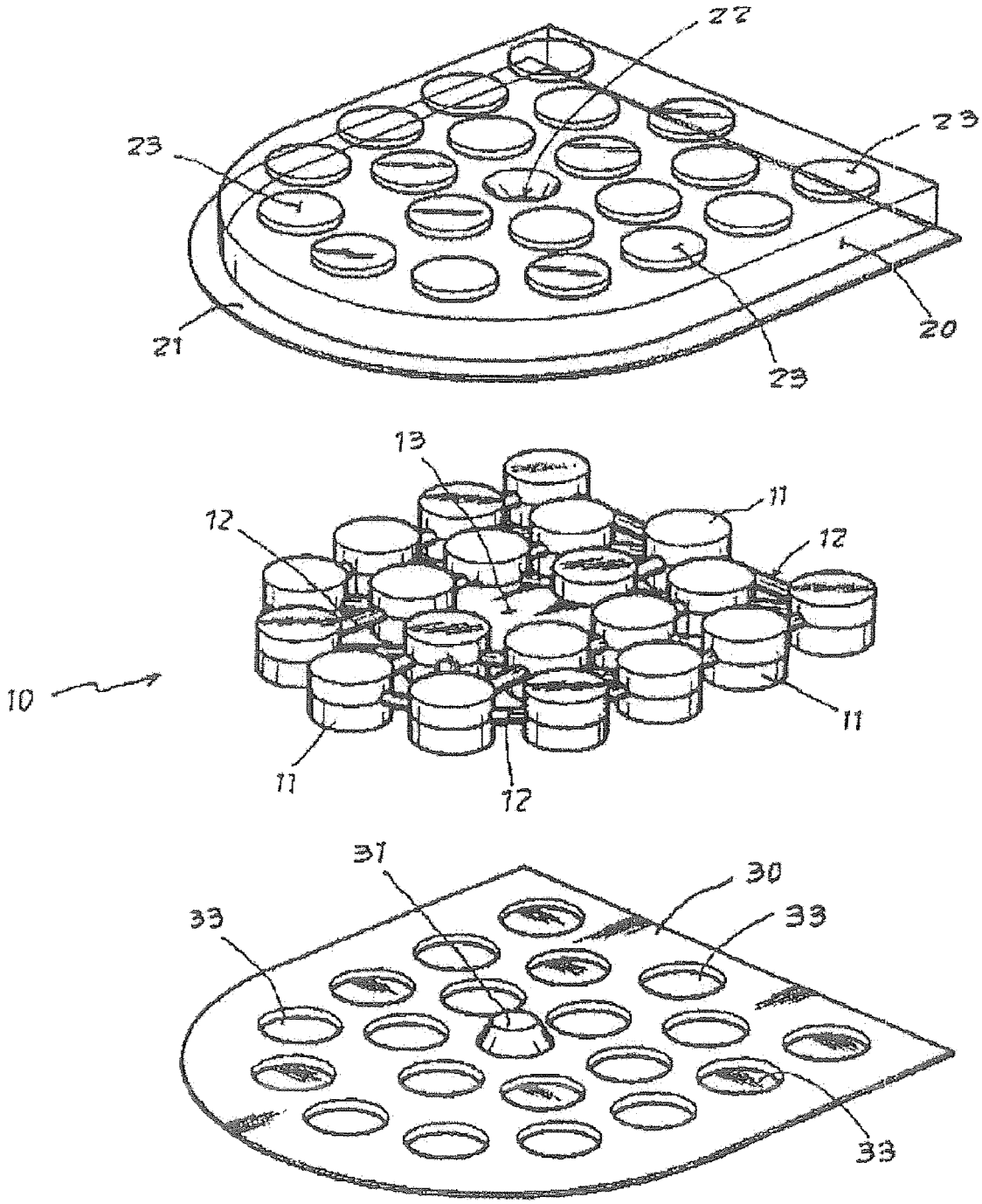
FIG. 2 is an exploded perspective view illustrating another conventional shock-absorbing structure for a shoe sole.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 3:
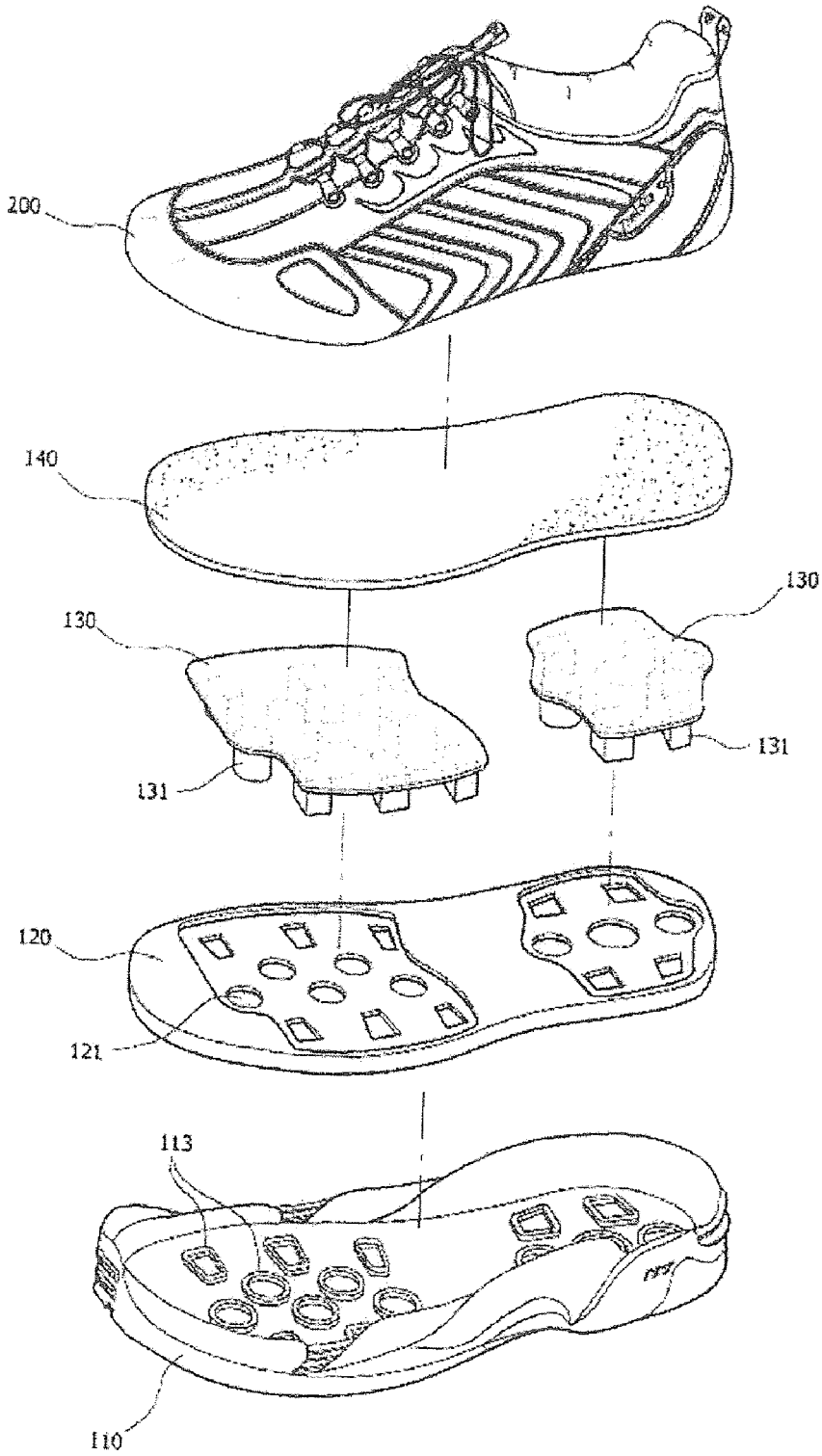
FIG. 3 is an exploded perspective view illustrating a shoe sole according to the present invention.
Figure 4:
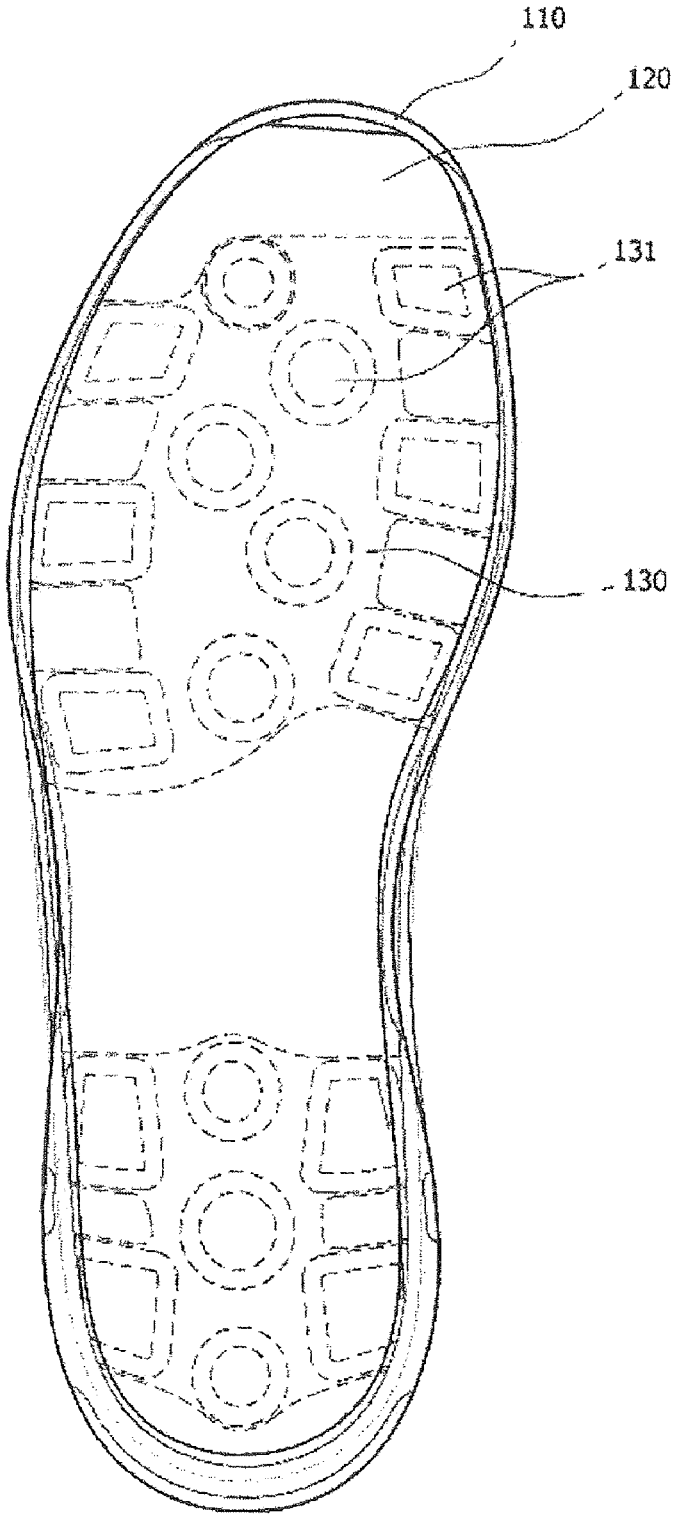
FIG. 4 is a plan view illustrating a shoe sole according to the present invention.
Figure 5:
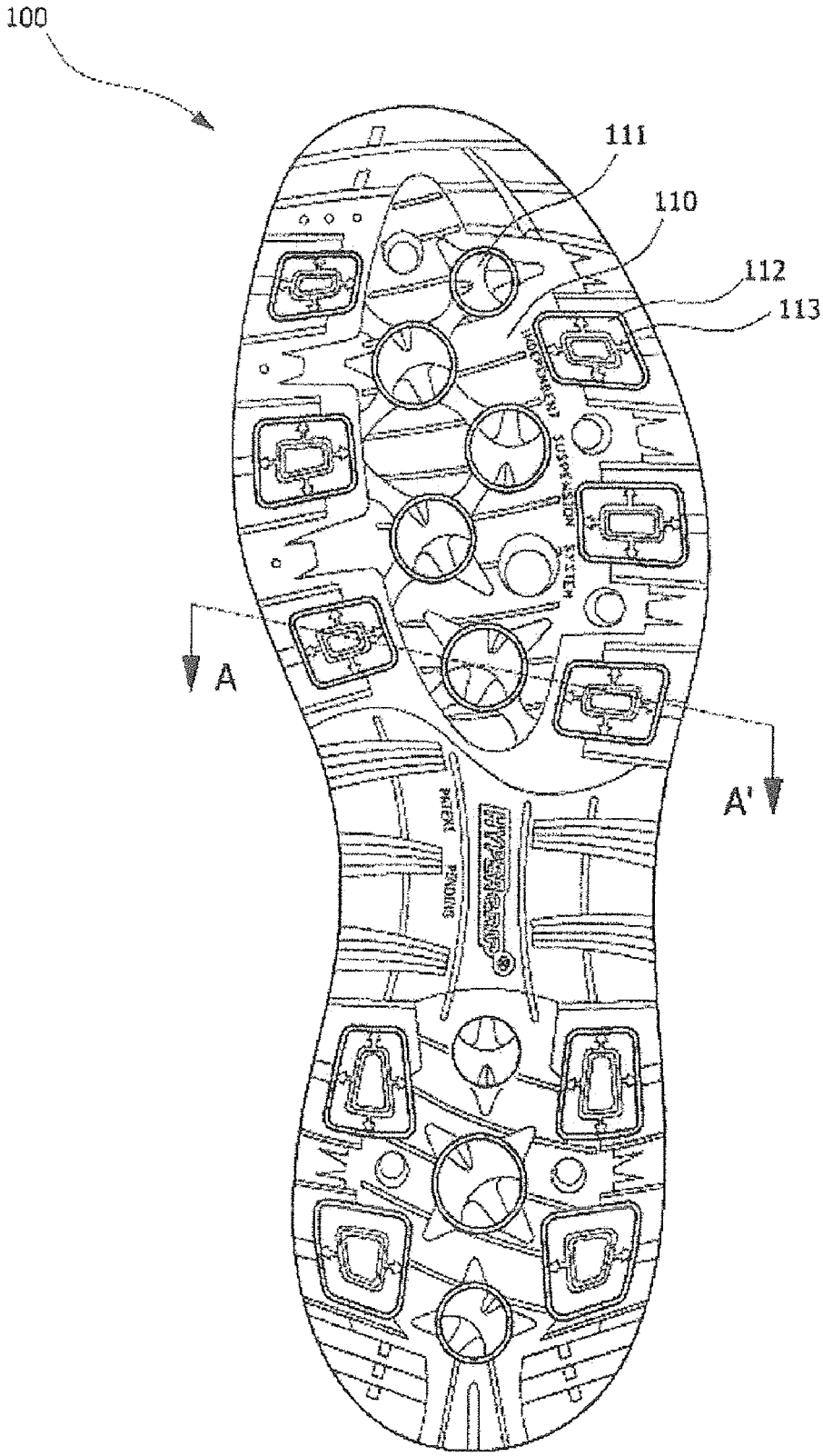
FIG. 5 is a bottom view illustrating a shoe sole according to the present invention.
Figure 6:
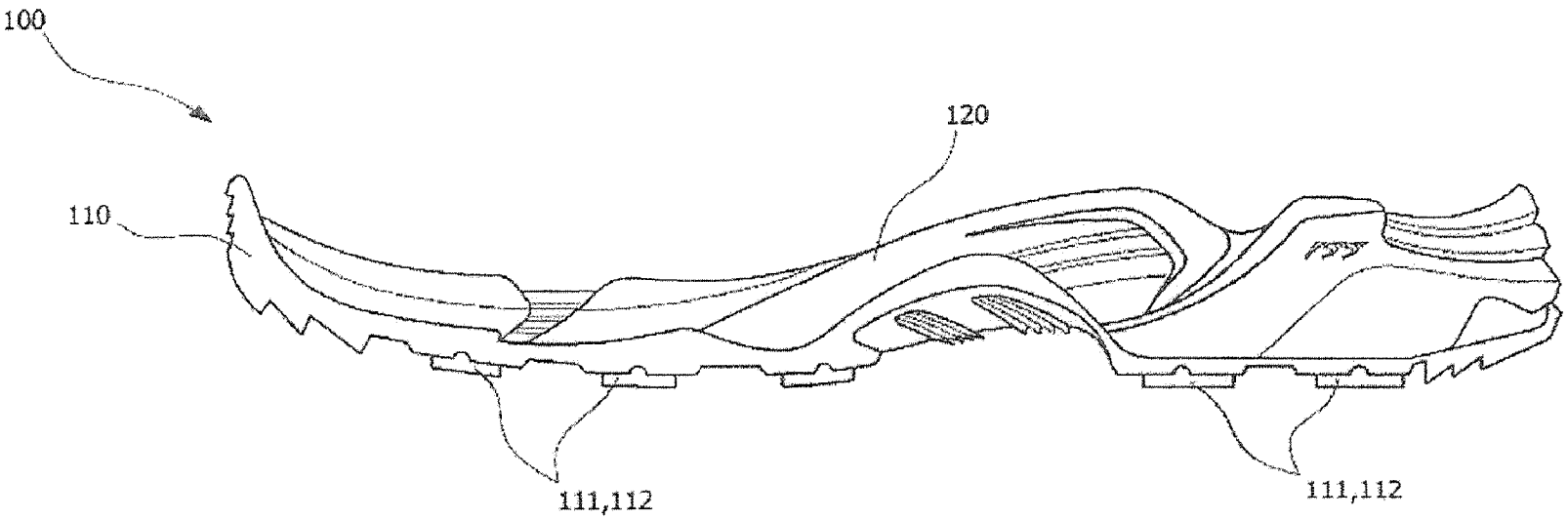
FIG. 6 is a side view illustrating a shoe sole according to the present invention.
Figure 7:
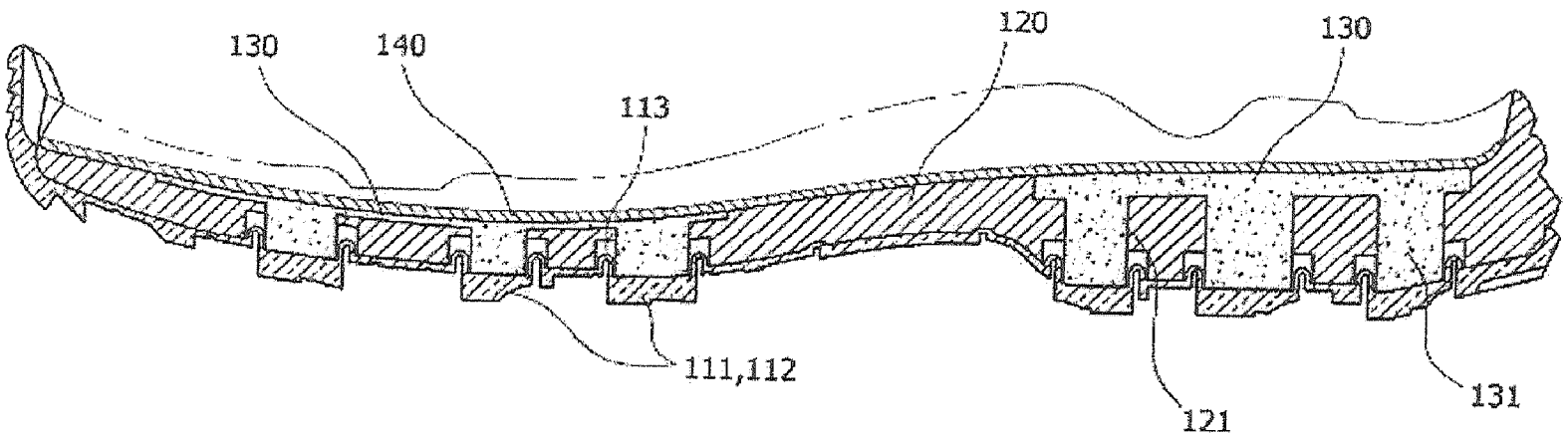
FIG. 7 is a side sectional view illustrating a shoe sole according to the present invention.

FIG. 3 is an exploded perspective view illustrating a shoe sole according to the present invention, FIG. 4 is a plan view of the shoe sole according to the present invention, FIG. 5 is a bottom view of the shoe sole according to the present invention, FIG. 6 is a side view of the shoe sole according to the present invention, and FIG. 7 is a side sectional view of the shoe sole according to the present invention.

As shown in FIGS. 3 to 7, the shoe sole 100 according to the present invention includes an outsole 110 provided at a bottom surface thereof with a plurality of protrusions 111 and 112, in which an outer peripheral portion of an upper end of each protrusion is integrally connected with the bottom surface by means of outer wheels 113 having an inverted-U shaped section and forming closed loops;

a mid-sole 120 stacked on the upper surface of the outsole 110 and formed with perforation holes 121 aligned corresponding to the outer wheels 113;

an insert 130 stacked on an upper surface of the mid-sole 120 and provided at a bottom surface thereof with a plurality of protrusions 131, which are aligned corresponding to the perforation holes 121 of the mid-sole 120; and a lasting board 140 stacked on an upper surface of the insert 130 coupled with the mid-sole 120.

When viewed in a bottom view, protrusions 111 having a circular shape are formed at the center portion of the bottom surface of the outsole 110 and protrusions 112 having an asymmetric rectangular shape are provided at outer peripheral portions of the bottom surface of the outsole 110. However, the shape and the position of the protrusions 111 and 112 can be changed according to applications thereof.

In addition, when viewed in a plan view, the outer wheels 113, which have the inverted-U shaped section and serve as connection members for connecting the protrusions 111 and 112 to the bottom surface of the outsole 110, may form the closed loops for surrounding the protrusions 111 and 112 and protrude upward from the upper surface of the outsole 110. When external impact is transferred to the protrusions 111 and 112 from the ground, the outer wheels 113 are elastically deformed so that the protrusions 111 and 112 can move independently from each other.

In addition, lower end portions of the protrusions 131, which protrude from the bottom surface of the insert 130, are inserted into the outer wheels 113 having the inverted-U shaped section. That is, the protrusions 131 of the insert 130 are inserted into the outer wheels 113, respectively, by passing through the perforation holes 121 of the mid-sole 120 stacked on the upper surface of the outsole 110.

Preferably, the insert 130 having the protrusions 131. protruding downward from the bottom surface of the insert 130 is made of polyurethane having high elasticity. In this case, the protrusions 131 are elastically deformed, respectively, when a local pressure is applied thereto from the protrusions 111 and 112 of the outsole 110, thereby absorbing the local pressure. When the local pressure being applied to the protrusions 131 has been released, the protrusions 131 may be restored to their original shapes due to the elastic restoring force of polyurethane.

Meanwhile, the mid-sole 120 stacked on the upper surface of the outsole 110 is fabricated by injection-molding EVA resin. Preferably, elasticity is imparted to the mid-sole 120, except for the perforation holes 121 of the mid-sole 120, into which the protrusions 131 of the insert 130 are inserted.

In addition, a plurality of perforation holes 121 are formed at front and rear portions of the mid-sole 120 corresponding to the protrusions 111 and 112 provided at front and rear portions of the outsole 110. Although the insert 130 can be fabricated as one piece (not shown), according to the preferred embodiment of the present invention, as shown in FIG. 3, a pair of inserts 130 are provided. In this case, one insert 130 has protrusions 131 aligned corresponding to the perforation holes formed at the front portion of the mid-sole 120 and the other insert 130 has protrusions 131 aligned corresponding to the perforation holes 121 formed at the rear portion of the mid-sole 120.

In addition, if the insert is fabricated as one piece with a size different from the size of the mid-sole, that is, if the size of the insert is smaller than that of the mid-sole or if a pair of inserts are provided, a stepped portion is formed when the insert is stacked on the upper surface of the mid-sole because the upper surface of the insert may protrude from the upper surface of the mid-sole. In this case, it is preferred to remove the stepped portion by planarizing the upper surface of the insert in line with the upper surface of the mid-sole through forming a recess on the upper surface of the mid-sole and accommodating the insert in the recess.

Figure 8:
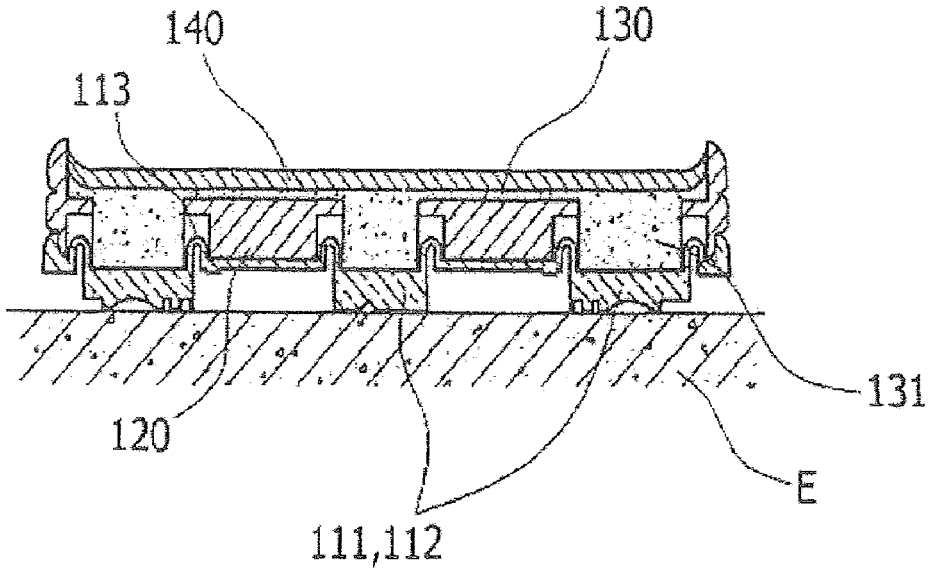
FIG. 8 is a sectional view taken along line A-A' shown in FIG. 5.
Figure 9:
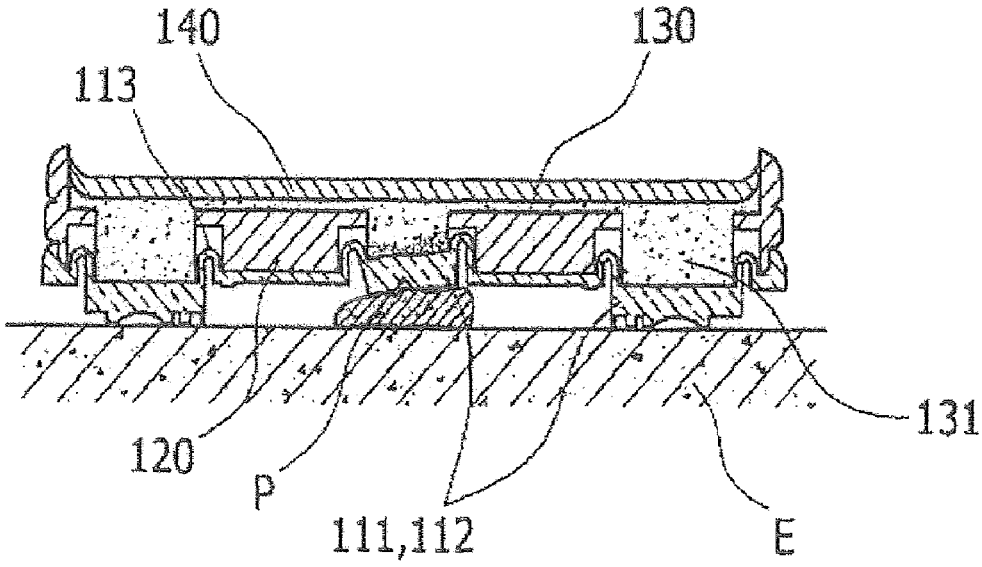
FIG. 9 is a cross-sectional view illustrating a shoe sole according to the present invention when the shoe sole makes contact with the ground.

FIG. 8 is a sectional view taken along line A-A' shown in FIG. 5, and FIG. 9 is a cross-sectional view illustrating the shoe sole according to the present invention when the shoe sole makes contact with the ground.

As shown in FIGS. 8 and 9, the shoe sole 100 according to the present invention includes the outer wheels 113 having the inverted-U shape, which are provided at upper end portions of the protrusions 111 and 112 protruding downward from the outsole 110 so as to connect the protrusions 111 and 112 to the bottom surface of the outsole 110. In addition, the protrusions 131 of the insert 130 are inserted into the outer wheels 113 by passing through the perforation holes 121 of the mid-sole 120.

Therefore, if load is applied to the protrusions 111 and 112 of the outsole 110 because of the weight of the user while the protrusions 111 and 112 are making contact with the irregular ground E, the outer wheels 113 provided at the upper end portions of the protrusions 111 and 112 are deformed such that the protrusions can move independently. Thus, the protrusions 131 of the insert 130 made of polyurethane may be elastically deformed corresponding to the movement of the protrusions 111 and 112 caused by elastic deformation of the outer wheels 113. In addition, when the outsole 110 is separated from the ground, the load applied to the protrusions 111 and 112 of the outsole 110 because of the weight of the user may be removed so that the protrusions 111 and 112 of the outsole 110 and the protrusions 131 of the insert 130 restore their original shapes.

In particular, as shown in FIG. 9, when predetermined protrusions 111 and 112 of the outsole 110 are placed on a protruding part P of the ground while the outsole 110 is making contact with the ground, relatively greater pressure is applied to the protrusions 111 and 112 placed on the protruding part P, so the degree of elastic deformation for the protrusions 111 and 112 is greater than that of other protrusions. However, the protrusions 131, which elastically support the protrusions 111 and 112, can absorb the elastic deformation of the protrusions 111 and 112, so that the elastic deformation force may not be transferred to adjacent protrusions 131 or the mid-sole 120. As a result, the inner bottom section of the shoe sole 100 can be horizontally maintained.

Preferably, the outer wheel 113, which connects the bottom surface of the outsole 110 with the protrusions 111 and 112 protruding from the outsole 110, has a thickness in a range of about 1.1 to 1.3 mm. If the thickness of the outer wheel 113 is less than 1.1 mm, the outer wheel 113 cannot sufficiently support the protrusions 111 and 112 against the external pressure. In contrast, if the thickness of the outer wheel 113 exceeds 1.3 mm, the elastic deformation of the outer wheel 113 may not be easily achieved against the external pressure.

As described above, according to the shoe sole of the present invention, the protrusions of the insert coupled with the mid-sole while being stacked on the mid-sole are inserted into outer wheels corresponding to the protrusions of the outsole, and the protrusions of the outsole are moved independently from each other by means of the outer wheels having the inverted-U shaped section, so that external impact applied to the protrusions of the outsole can be effectively absorbed and the inner bottom section of the footwear can be horizontally maintained. Thus, the shoe sole according to the present invention can attenuate foot fatigue and provide comfortable wearing feeling even when the user walks on an unpaved road or climbs a mountain.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A shoe sole comprising:

an outsole provided at a bottom surface thereof with a plurality of protrusions, in which an outer peripheral portion of an upper end of each protrusion is integrally connected with the bottom surface by means of outer wheels protruding upward from an upper surface of the outsole while forming closed loops;

a mid-sole stacked on the upper surface of the outsole and formed with perforation holes aligned corresponding to the outer wheels;

an insert stacked on an upper surface of the mid-sole and provided at a bottom surface thereof with a plurality of protrusions, which are inserted into the outer wheels by passing through the perforation holes of the mid-sole; and a lasting board stacked on an upper surface of the insert coupled with the mid-sole.

2. The shoe sole as claimed in claim 1, wherein the protrusion of the outsole has a circular shape or an asymmetric rectangular shape.

3. The shoe sole as claimed in claim 1, wherein the outer wheel has an inverted-U shaped section.

4. The shoe sole as claimed in claim 3, wherein the outer wheel has a thickness of about 1.1 to 1.3 mm.

5. The shoe sole as claimed in claim 1, wherein the insert is made of polyurethane having high elasticity.

* * * * *